US007010253B2

(12) United States Patent
Kakimoto

(10) Patent No.: US 7,010,253 B2
(45) Date of Patent: Mar. 7, 2006

(54) DEVELOPING APPARATUS FEATURING FIRST AND SECOND DEVELOPING MEMBERS PROVIDED IN FIRST AND SECOND TONER CONTAINER CHAMBERS, RESPECTIVELY

(75) Inventor: Hiroaki Kakimoto, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 199 days.

(21) Appl. No.: 10/727,620

(22) Filed: Dec. 5, 2003

(65) Prior Publication Data

US 2004/0136755 A1 Jul. 15, 2004

(30) Foreign Application Priority Data

Dec. 9, 2002 (JP) ..... 2002-356575

(51) Int. Cl.
*G03G 15/09* (2006.01)

(52) U.S. Cl. ..... 399/269

(58) Field of Classification Search ..... 399/267, 399/269

See application file for complete search history.

(56) References Cited

U.S. PATENT DOCUMENTS 4,063,533 A * 12/1977 White ..... 399/269
4,724,457 A * 2/1988 Abreu et al. ..... 399/269
5,995,790 A * 11/1999 Takeda ..... 399/269
2004/0022560 A1 * 2/2004 Hirobe et al. ..... 399/269
2004/0105705 A1 * 6/2004 Hirobe ..... 399/269

FOREIGN PATENT DOCUMENTS

JP 2000-155467 6/2000

* cited by examiner

*Primary Examiner*—William J. Royer
(74) *Attorney, Agent, or Firm*—Fitzpatrick, Cella, Harper & Scinto

(57) ABSTRACT

The present invention relates to a developing apparatus for developing an electrostatic image formed on an image carrier, comprising a developing container, a first developing member formed at the first chamber for conveying developer to a first developing portion, a second developing member provided with the second chamber for conveying the developer to a second developing portion and a magnetic field generating means for generating magnetic field for transferring the developer between the first developing member and the second developing member. The diaphragm is disposed in a non-contacting manner to the first developing member and the second developing member and has a restricting member for restricting entry of the developer out of an interior of the developing container to a space between the first developing member and the second developing member.

9 Claims, 10 Drawing Sheets

DEVELOPING APPARATUS FEATURING FIRST AND SECOND DEVELOPING MEMBERS PROVIDED IN FIRST AND SECOND TONER CONTAINER CHAMBERS, RESPECTIVELY

BACKGROUND OF THE INVENTION

1. Field of the Invention

This invention relates to a developing apparatus for developing electrostatic images formed on an image carrier using, e.g., an electrophotographic method, an electrostatic recording method and, more particularly, to an apparatus used for photocopiers, printers, and facsimile machines.

2. Description of Related Art

Conventionally, color image forming apparatuses have been well known in which having plural developing apparatuses containing respectively developers of different colors and obtaining multicolor images using electrophotographic methods.

Referring to FIG. 3, described is a main cross-sectional structure of a conventional multicolor image forming apparatus. Exemplified herein as a conventional multicolor image forming apparatus is that four-color developing apparatuses are contained in a rotary body, which rotates by a prescribed angle at developing operation of respective colors to develop properly the images of respective colors.

In this prior art, the developing apparatus has a feature equipped with two developing rollers for respective colors, and the developer contains a two-component made of a so-called carrier serving as a magnetic agent and a toner for actually developing the latent image.

In this color image forming apparatus, an image processing means is constituted of a photosensitive drum 1 serving as an image carrier, a primary charger 2 as a charging means, a laser scanner 3 providing image information, a rotary type developing apparatus 5 supporting developing devices 4*a*, 4*b*, 4*c*, 4*d* as four developing means, an intermediate transfer body 6, and a cleaning apparatus 7 collecting remaining transfer toner.

The image processing means ensures a size in the longitudinal direction corresponding to a prescribed length in the longitudinal direction of the photosensitive drum 1 required for image formation of a prescribed width.

The rotary type developing apparatus 5 is of a type settling one of four developing devices 4*a* to 4*d* to a developing position according to the rotation of a supporting body 9. The rotary type developing apparatus 5 has development opening surfaces for the respective developing devices 4*a* to 4*d* on a circumference of a circle whose center is at a support body rotary shaft 8.

The developing devices 4*a* to 4*d* have first developing rollers 10*a*, 10*b*, 10*c*, 10*d* and second developing rollers 11*a*, 11*b*, 11*c*, 11*d* serving as rotary developer carriers for conveying the toner to a portion contacting to the photosensitive drum 1.

The rotary type developing apparatus 5 has a structure that only during the developing operation the first developing rollers 10*a*, 10*b*, 10*c*, 10*d* and the second developing rollers 11*a*, 11*b*, 11*c*, 11*d* in the developing devices 4*a* to 4*d* are made closer to the photosensitive drum 1 within a prescribed amount by moving the developing devices 4*a* to 4*d* with positioning apparatuses 12*a*, 12*b*, 12*c*, 12*d* and that during the rotation of the rotary type developing apparatus 5 as well as during non-development operation the first developing rollers 10*a*, 10*b*, 10*c*, 10*d* and the second developing rollers 11*a*, 11*b*, 11*c*, 11*d* in the developing devices 4*a* to 4*d* are isolated from the photosensitive drum 1 by releasing the contacting operation of the positioning apparatuses 12*a*, 12*b*, 12*c*, 12*d*.

Referring to FIG. 4 and FIG. 5, the developing device positioning apparatus for the rotary type developing apparatus in FIG. 3 is described. Numeral 20 denotes a photosensitive drum; numeral 21 denotes a supporting body of a rotary type developing apparatus 22; numeral 23 denotes a developing device. The developing device 23 has mounted therein a first developing roller 24 and a second developing roller 25. The developing device 23 is installed movably on a developing guide 26. The developing guide 26 is set so that the first developing roller 24 and the second developing roller 25 are movable parallel with the surface of the photosensitive drum 20 up to coming closer in a prescribed amount. Numeral 27 is a positioning cam and moves pivotally around a pivotal shaft 28. A roller 29 is disposed rotatably at a tip thereof.

The rotary type developing apparatus 22 rotates the developing device 23 by a rotary driving means, not shown, to a prescribed position on the photosensitive drum 20 at which the electrostatic latent image can be developed. The positioning cam is rotated in arrow B direction in the drawing with a drive apparatus, not shown, around the pivotal shaft 28. According to this rotation, the developing device 23 moves in arrow C direction in the drawing and reaches the state shown in FIG. 5.

In FIG. 5, a part of a container 30 hits a hitting member, not shown, of the supporting body 21 to cease the developing device 23, so that the developing device 23 is held as it is according to a holding force of the positioning cam 27. In this state, the first developing roller 24 and the second developing roller 25 of the developing device 23 can come closer to the prescribed amount such that the electrostatic latent images on the photosensitive drum 20 can be properly developed. The prior art has a structure that this prescribed amount is in a range from 200 microns to 400 microns.

Next, a process for forming color images on a transfer material using this color image forming apparatus is described.

The photosensitive drum 1 is rotated in arrow A direction, and the primary charger 2 charges the photosensitive drum 1 uniformly. Exposure 13 by the laser scanner 3 then forms electrostatic latent images on the photosensitive drum 1. These latent images are corresponding to color developing agent developers in the developing devices 4*a* to 4*d*, or namely respective colors such as yellow (Y), magenta (M), cyan (Y), and black (Bk).

Regarding to the first color, the electrostatic latent image corresponding to, e.g., the yellow developer is formed on the photosensitive drum 1, and the image, after being visualized with the known process among the developer rollers 10*a*, 11*a* of the developing device 4*a* in which the yellow developer is contained, and the photosensitive drum 1, is transferred with a first transfer roller 14 to the intermediate transfer body 6.

Subsequently, after the remaining toner on the photosensitive drum 1 is cleaned up with the cleaning apparatus 7 such as a blade or the like, the electrostatic latent image corresponding to, e.g., the developer, as the second color, is formed on the photosensitive drum 1, and the image, after being visualized with the known process among the developer rollers 10*b*, 11*b* of the developing device 4*b* in which the magenta developer is contained, and the photosensitive drum 1, is transferred in an overlapping manner with the first transfer roller 14 to the intermediate transfer body 6 to which the yellow visualized image of the first color is transferred.

After the above operations are done in a plural number, the toner overlapped as plural layers on the intermediate transfer body 6 is transferred onto a transfer material 102 as described below.

Hereinafter, the step that the toner of the plural layers on the intermediate transfer body 6 is transferred onto the transfer material 102 is described.

A transfer material 102 stacked on a cassette 101 in FIG. 3 is fed out with a pickup roller 103, and the topmost transfer material P2 is solely transferred on a downstream side by a feeding roller 104 and a reverse separation roller 105 rotating in the reverse direction to the feeding direction. The transfer material P2 is then conveyed along a conveyance path by plural conveyance roller pairs 106, and is bent upon the front end's engagement with a nipping portion of a stopped registration roller pair 107, thereby being corrected from obliquely feeding.

The registration roller pair 107 begins rotating at a timing synchronized with a toner image formed on the intermediate transfer body 6, thereby feeding out the transfer material 102. The fed transfer material 102 enters in the nipping portion formed with the intermediate transfer body 6 and a second transfer roller 108, and the toner image on the intermediate transfer body 6 is transferred to the transfer material (P1 in FIG. 3).

The transfer material P1 is then conveyed with a conveyance belt 109 to a fixing apparatus 110 made of two rollers, located on upper and lower sides. The toner image on the transfer material P1 at the fixing apparatus 110 is fixed to the transfer material P1, and is delivered to a delivery tray 112 via delivery rollers 111.

Such a color image forming apparatus has been proposed as an example of a color image forming apparatus particularly for higher image quality than the usual image quality. Such an apparatus has a feature that each of the four-color developing devices contained in the rotary body has two developing rollers. Described herein as an example of such an apparatus feature is that the four-color developing devices contained in the rotary body have the same shape and the same mass and are disposed equally with 90 degrees spaced with respect to a rotary center of the rotary body.

Next, the developing device in the rotary body is described.

FIG. 6 and FIG. 7 show two states taken by the developing device in a rotary body 40. In FIG. 7, numeral 41 shows a photosensitive drum, and FIG. 7 shows a situation that the electrostatic latent image on the photosensitive drum 41 is developed by an developer of a developing device 42. The rotary body 40 has a structure to rotate by each of 90 degrees in the counterclockwise direction (arrow D in the drawing). FIG. 6 shows the state that the rotary body 40 is located at a position of −90 degrees in the rotational direction of the rotary body 40 (rotational direction of the rotary body 40 is defined as "+") with respect to the developing position shown in FIG. 7.

With reference to FIG. 6, an internal structure of the developing device 42 is described. The developing device 42 has a first developing roller 44 and a second developing roller 45, and each of the developing rollers 44, 45 has a first developing sleeve 46 and a second developing sleeve 47, which are in a rotatable state with a drive mechanism, not shown, and a first magnet roller 48 and a second magnet roller 49 stationally formed at respective centers of the developing rollers 44, 45.

As shown in FIG. 6, the magnetic polarity arrangement of the first magnet roller 48 and the second magnet roller 49 is such that the north polarity and the south polarity are set entirely reverse to each other.

In the developing device 42, a first screw 50 and a second screw 51 are disposed. A diaphragm 53 structured by a part of a container 52 is projected between the first screw 50 and the second screw 51, thereby forming a developing chamber 54 enclosed with the first developing roller 44 and a stirring chamber 55 enclosed with the second developing roller 45, respectively. The opposite ends in the longitudinal direction of the first screw 50 and the second screw 51 are supported with bearings, not shown.

For the purpose of the explanation, the space between the first developing roller 44 and the second developing roller 45 is defined as an SS space 56.

A situation shown in FIG. 6 is described. As described above, FIG. 6 shows the state of −90 degrees with respect to the developing position, and in this state, the first developing roller 44 and the second developing roller 45 are positioned on a substantially lower side, and therefore, a developer 57 existing in the developing device 42 is deposited as to overlap the first developing roller 44 and the second developing roller 45 by operation of the gravity force as shown with "circle patterns" in FIG. 6. From another viewpoint, the developing 57 developer is attracted by magnetic force of the first magnet roller 48 and the second magnet roller 49 in the first developing roller 44 and the second developing roller 45, and a space including the SS space 56, other than an empty space at an upper portion of the developing chamber 54 and the stirring chamber 55, is filled with the developer 57 by a synergy effect with the above gravity force.

Next, the state shown in FIG. 7 is described below. As described above, FIG. 7 shows a state for developing position, and in this state, the first developing roller 44 and the second developing roller 45 are in a drive state, while the first developing sleeve 46 and the second developing sleeve 47 rotate in directions of arrows E, F.

Regarding the first screw 50 and the second screw 51, as shown in the drawing in respect with the developer 57 in the developing device 42, the lead and rotational direction of the first screw 50 is set so that the developer 57 is conveyed in a direction toward the front side of the drawing, and similarly, the lead and rotational direction of the second screw 51 is set so that the developer 57 is conveyed in a direction toward the rear side of the drawing. The developing chamber 54 containing the first screw 50 and the stirring chamber 55 containing the second screw 51 are structured to communicate with each other at the opposite ends in the longitudinal direction.

Referring to FIG. 8, the flow of the developer 57 existing in the developing device 42 is described. FIG. 8 is a schematic view showing a cross section along an axial line extending in the longitudinal direction of a developing device 60. Numeral 61 denotes a first screw described in FIGS. 6, 7; numeral 62 denotes a second screw; numeral 63 denotes a developing chamber containing the first screw 61; numeral 64 denotes a stirring chamber containing the second screw 62. Numeral 65 denotes a toner hopper for supplying a toner 66 to the developing device 60.

One flow is for equalizing the toner density of the developer in the developing device 60. The toner 66 supplied from the toner hopper 65 is supplied to the developing device 60 from extension 641 of the stirring chamber 64 and conveyed in the stirring chamber 64 in arrow direction of arrows G, H as stirred with the carrier in the stirring chamber 64 and as maintaining the state of the developer. The toner 66 at that time receives further triboelectric charges from adequate stirring with the carrier.

The developer is overly filled at an end 642 of the stirring chamber 64 because the developer is sent to the second screw 62. The end 642 of the stirring chamber 64 is structured with a communication path 67 in communication with the end 632 of the developing chamber 63, so that overly filled developer enters toward a side of the end 632 of the developing chamber or first chamber 63.

The first screw 61 of the developing chamber 63 conveys the developer in the developing chamber or first chamber 63 in a direction of arrow I in the drawing. The developer conveyed in the developing chamber 63 reaches the other end 631 of the developing chamber 63. Another communication path 68 in communication with the stirring chamber or second chamber 64 is formed even at the other end 631 of the developing chamber 63, so that the developer is circulated into a merging portion 643 of the stirring chamber 64 again.

Other flows of the developer are used for a process developing the electrostatic latent image on the photosensitive drum 41 with the developer in the developing device 42. This flow is described with reference to FIG. 7.

As shown in FIG. 7, the developer 571 in the developing chamber 54 faces to the first developing roller 44, and a part of the developer 571 conveyed thereto is fed around the surface of the first developing sleeve 46 by magnetic attracting force of the first magnet roller 48 of the first developing sleeve 46, and is carried as a thin layer with a restricting blade 58. The developer 57 develops the electrostatic latent image on the surface of the photosensitive drum 41 according to the rotation of the first developing sleeve 46 and is further conveyed to the second developing roller 45.

As a feature of the magnetic polarity arrangement of the first magnet roller 48 and the second magnet roller 49, the magnetic flux density is made higher at a space between the N1 polarity 481 of the first magnet roller 48 and the S2 polarity 491 of the second magnet roller 49 because the N1 polarity 481 of the first magnet roller 48 and the S2 polarity 491 of the second magnet roller 49 are arranged as opposed to each other, so that transfer of the developer 571 can be done surely from the first developing sleeve 46 to the second developing sleeve 47, and so that the toner and the carrier can be prevented from scattered between the sleeves 46, 47.

The second developing roller 45 carries the developer 571 to the surface of the second developing sleeve 47 in substantially the same manner by the magnetic attracting force of the second magnet roller 49. The developer 571 on the surface of the second developing sleeve 47 performs the second development of the electrostatic latent image on the photosensitive drum 41. Accordingly the two developments with the first developing roller 44 and the second developing roller 45 render the developer 571 entering into the stirring chamber 55 in the developing device 42 again in a state that the toner density of the developer 571 is lowered. In the stirring chamber 55, the developer 572 is stirred and conveyed by the second screw 51, exists and merges with the developer 571.

In a meantime, as described above, almost all of the space including the SS space 56 is filled with the developer 57 by the synergy effect of the gravity force and the magnetic force of the two magnet rollers 48, 49.

If the rotary body 40 is rotated to a developing position shown in FIG. 7 from this state, the developer 57 in the developing device 42 is located in a range shown with "circle patterns" and "dot patterns" in the drawing.

Regarding the developer 571 of "circle patterns" in FIG. 7, as shown as the prior art, while the agent is circulated by the two developing screws 50, 51 in the developing device 42, a part of the agent is carried with two developing rollers 44, 45 to contribute the development of the electrostatic latent image on the photosensitive drum 41.

On the other hand, the portion shown with "dot patterns" in FIG. 7 is a portion defined as the SS space 56 in FIG. 6 and is a portion at which the developer 573 is carried by magnetic force of the two magnet rollers 48, 49. In this SS space 56, the S2 polarity 482 of the first magnet roller 48 and the N1 polarity 492 of the second magnet roller 49 are arranged as to be opposed to each other, so that the magnetic flux density is made higher between the polarities, and so that the SS space 56 is subject to higher constraint force against the developer 573 by the magnetic force.

The developer 573 is a agent that is circulated into the stirring chamber 55 after the developing operation of the previous time and that is contained in the stirring chamber 55. That is, the developer 573 is a developer with a reduced toner density, which is entirely different from the developer passing through the restricting blade 58 under the regular process. In the state shown in FIG. 6, the developer enters into the SS space 56.

The developer 573 carried in the SS space 56 is conveyed to the second developing sleeve 47 again as shown in arrow K in FIG. 7, and the coating amount of the developer of the second developing sleeve 47 greatly excesses the coating amount of the first developing sleeve 47 normalized with the restricting blade 58.

With such a state that the developer is mixed, not only defective image such as reduced density after duration may be formed, but also the coating amount of the second developing sleeve 46 itself becomes greatly larger than the proper amount, in the developing process of the electrostatic latent image on the photosensitive drum 41, thereby raising various problems such that blurs and overflows from the container 52 simply occur to scatter the toner in the device.

This invention is made in consideration of the above problems. It is an object to provide a developing apparatus avoiding a developer to be coated more than the necessary amount on a developing roller to prevent blurs and overflows out of a container form occurring and to obtain developed images with high quality.

SUMMARY OF THE INVENTION

It is an object of the invention to provide a developing apparatus capable of restricting entry of a developer into a space between a first developer carrier and a second developer carrier.

It is another object of the invention to provide a developing apparatus, without reducing the duration of the first developer carrier and the second developer carrier, capable of restricting entry of a developer into a space between a first developer carrier and a second developer carrier.

It is yet another object of the invention to provide a developing apparatus for developing an electrostatic image formed on an image carrier, comprising: a developing container containing a magnetic developer; a diaphragm substantially dividing the developing container into a first chamber and a second chamber constituting a circulation path of the developer, the first chamber being disposed on an upper side of the second chamber; a developing container for containing a magnetic developer, the developing container being divided into a first chamber and a second chamber constituting a circulation path of the developer, the first chamber being disposed on an upper side of the second chamber;

a first developing member, provided within the first chamber, for supplying the developer to the electrostatic image on the image carrier;

a second developing member, provided within the second chamber, for supplying the developer to the electrostatic image on the image carrier; and a magnetic field generating means for generating a magnetic field for transferring the developer from the first developing member to the second developing member on the image carrier side, and a restricting member for restricting entry of the developer in the developing container to a space between the first developing member and the second developing member, the restricting member being disposed in the developer container in a non-contacting manner with the first developing member and the second developing member.

Further objects of the invention will be apparent from reading the following detailed description in reference to the attached drawings.

DETAILED DESCRIPTION OF THE PREFERRED EMBODIMENTS

Figure 1:
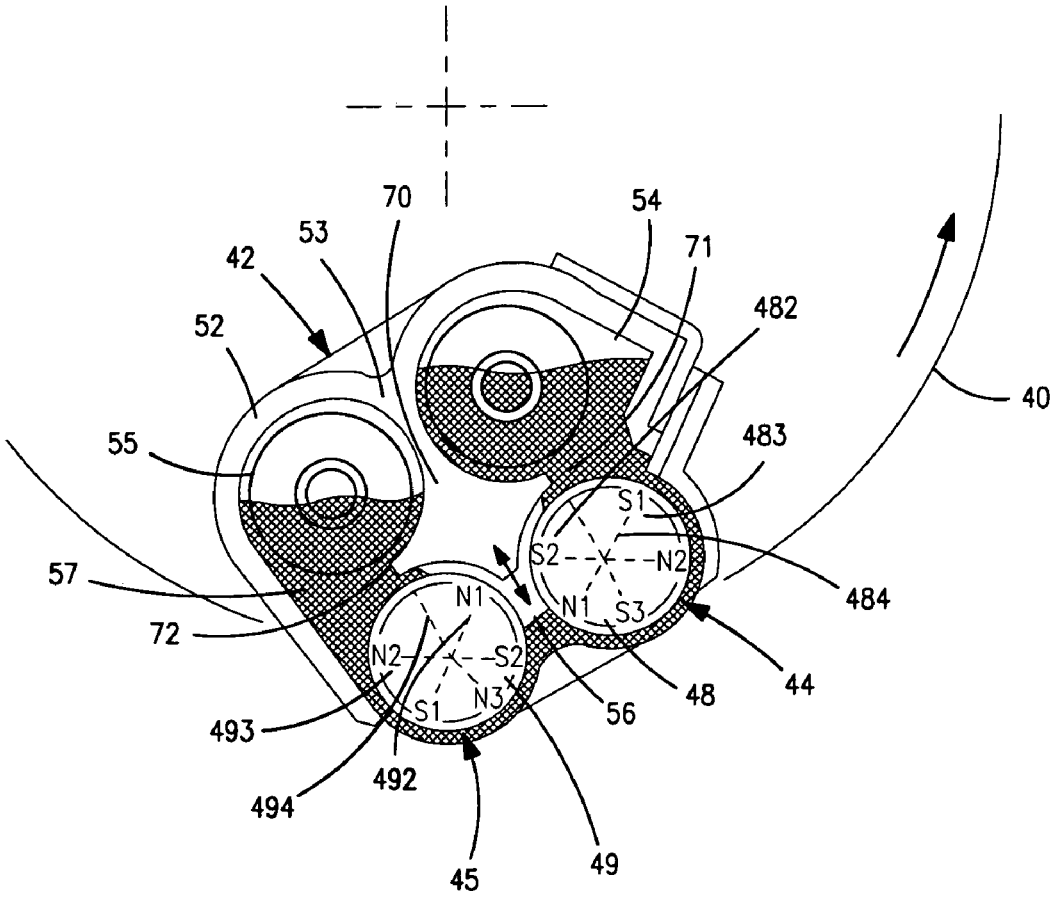
FIG. 1 is a diagram showing a state that a developing device is isolated from a photosensitive drum according to the invention.

Hereinafter, referring to the drawings, the preferred embodiments of the invention are described in detail in an exemplifying manner. Size, material, and shape of structural parts as set forth in the embodiments below, and correlated arrangement of those parts can be modified properly according to the constitution of the apparatus to which this invention applies and various conditions, and as far as no special description is made, it is not intended that the scope of the invention is limited to those embodiments only.

[First Embodiment]

Figure 2:
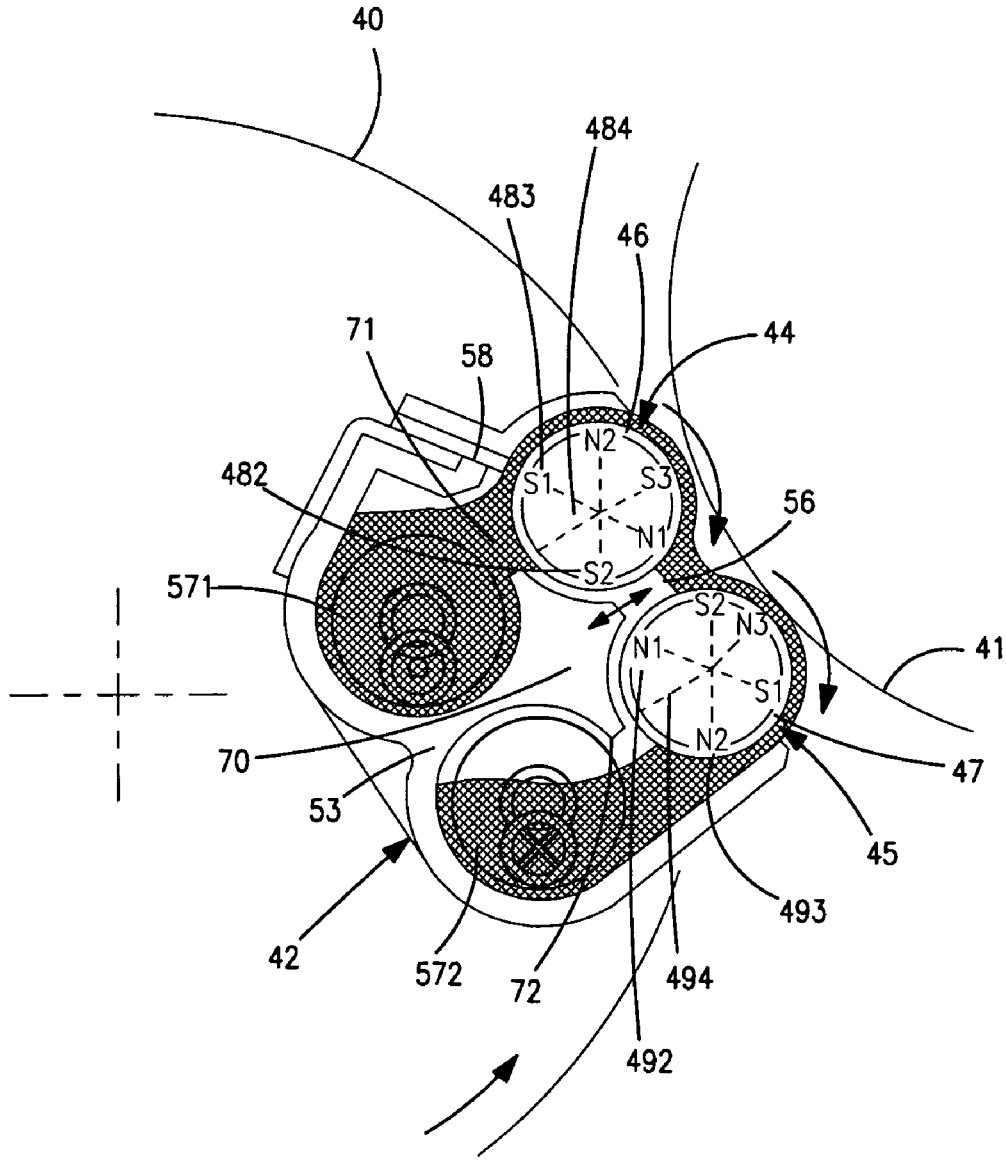
FIG. 2 is a diagram illustrating a flow of a developer in the developing device according to the invention.
Figure 3:
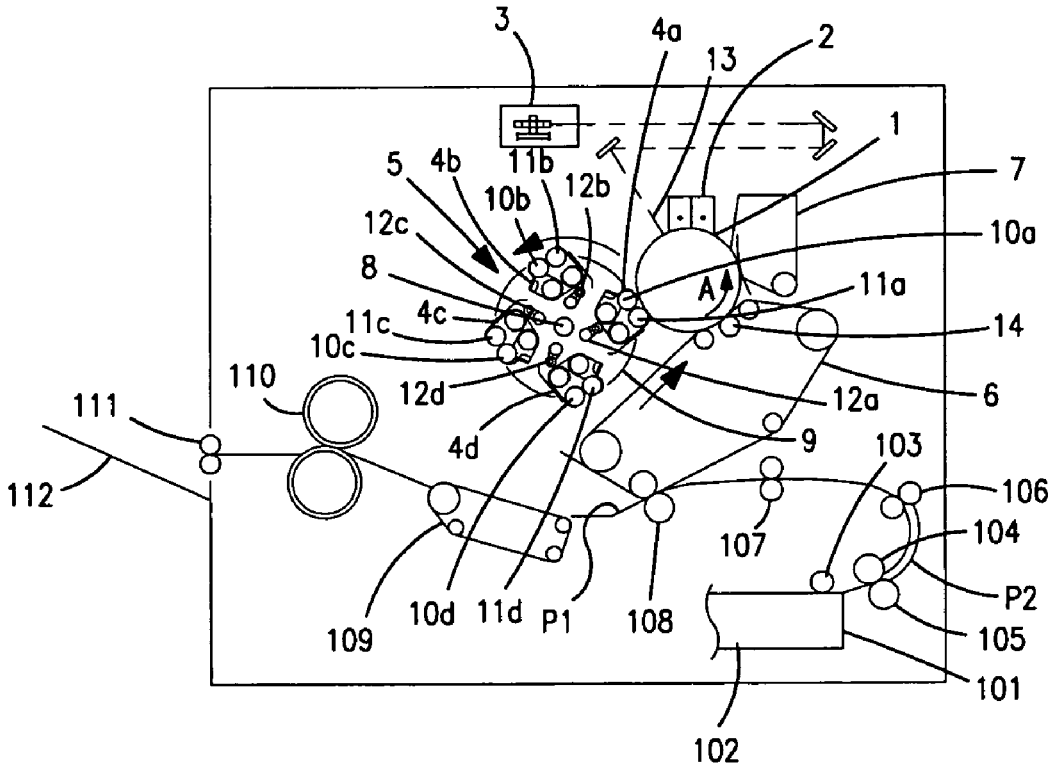
FIG. 3 PRIOR ART
FIG. 3 is an illustration showing a color image forming apparatus mounting a rotary type developing apparatus.
Figure 4:
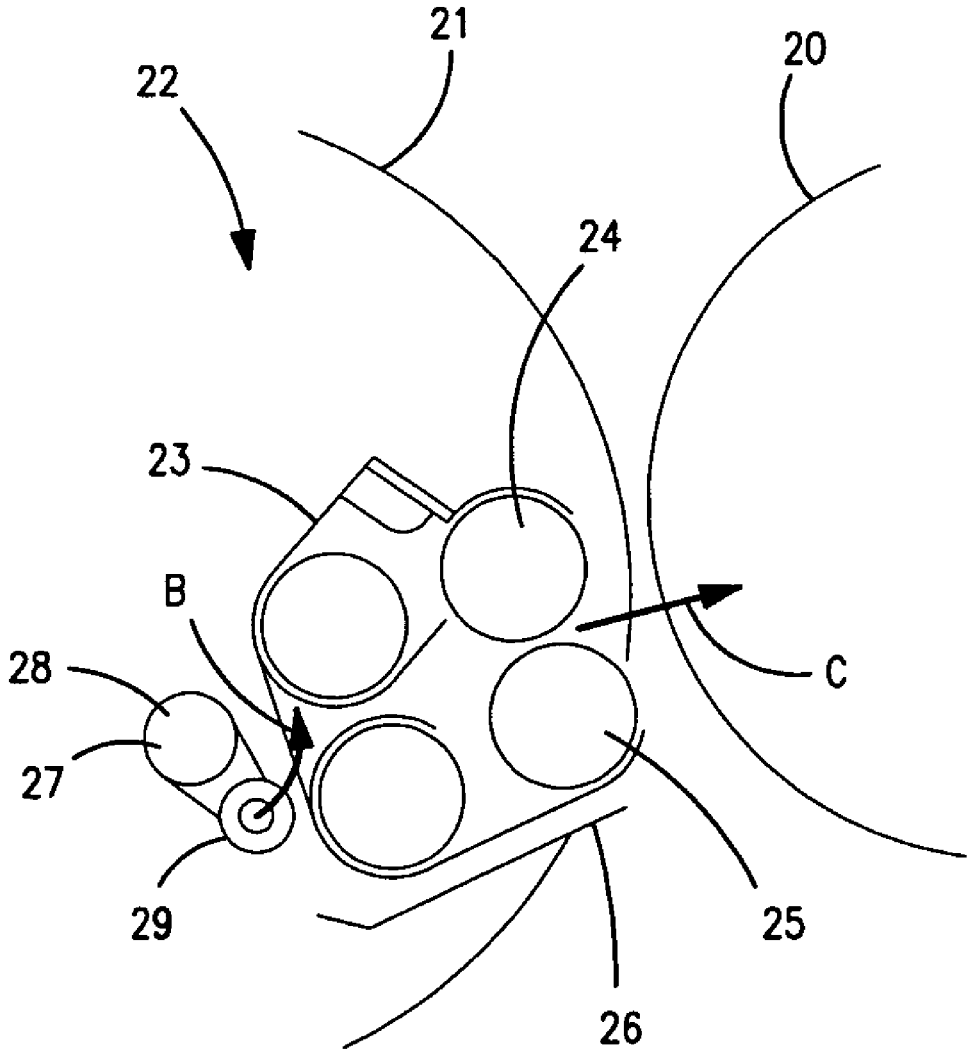
FIG. 4 PRIOR ART
FIG. 4 is a diagram showing a pre-operation state of a development positioning apparatus at a developing position.
Figure 5:
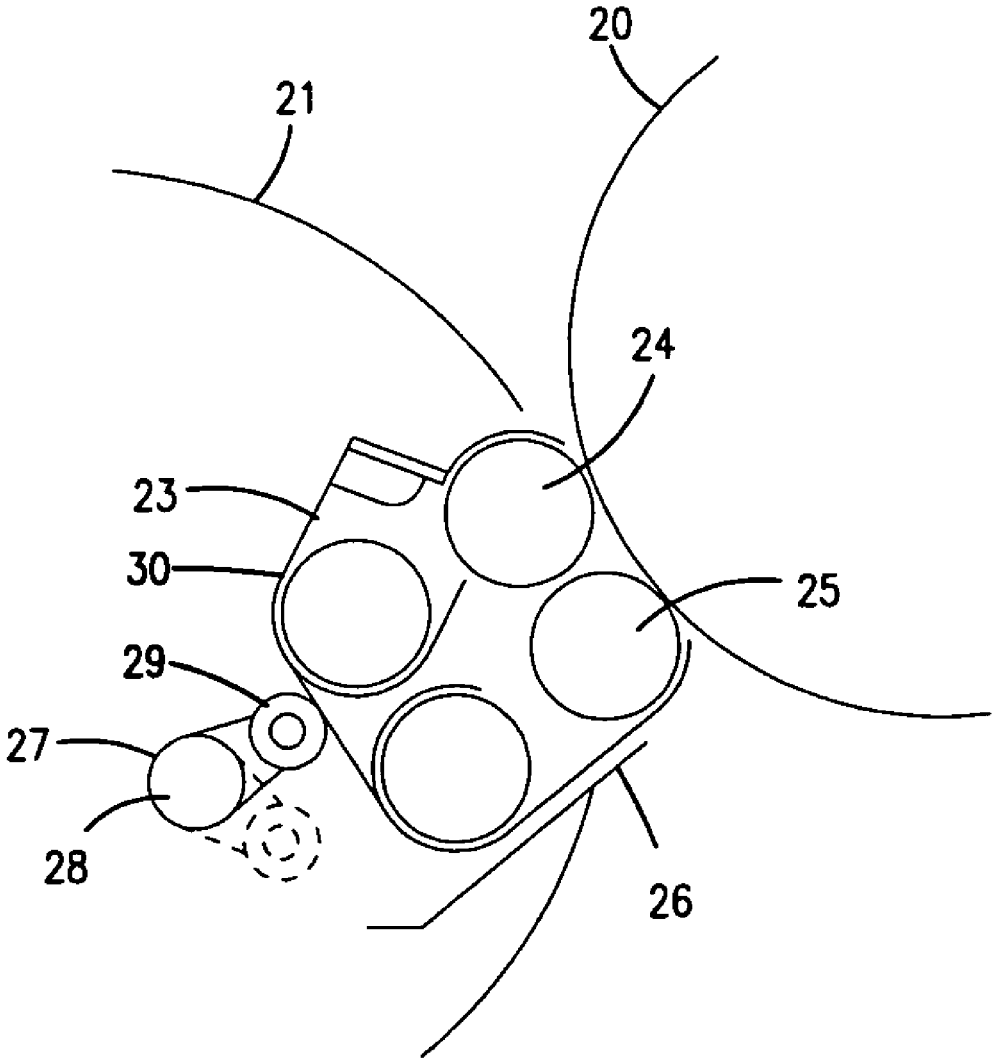
FIG. 5 PRIOR ART
FIG. 5 is a diagram showing a post-operation state of the development positioning apparatus at the developing position.
Figure 6:
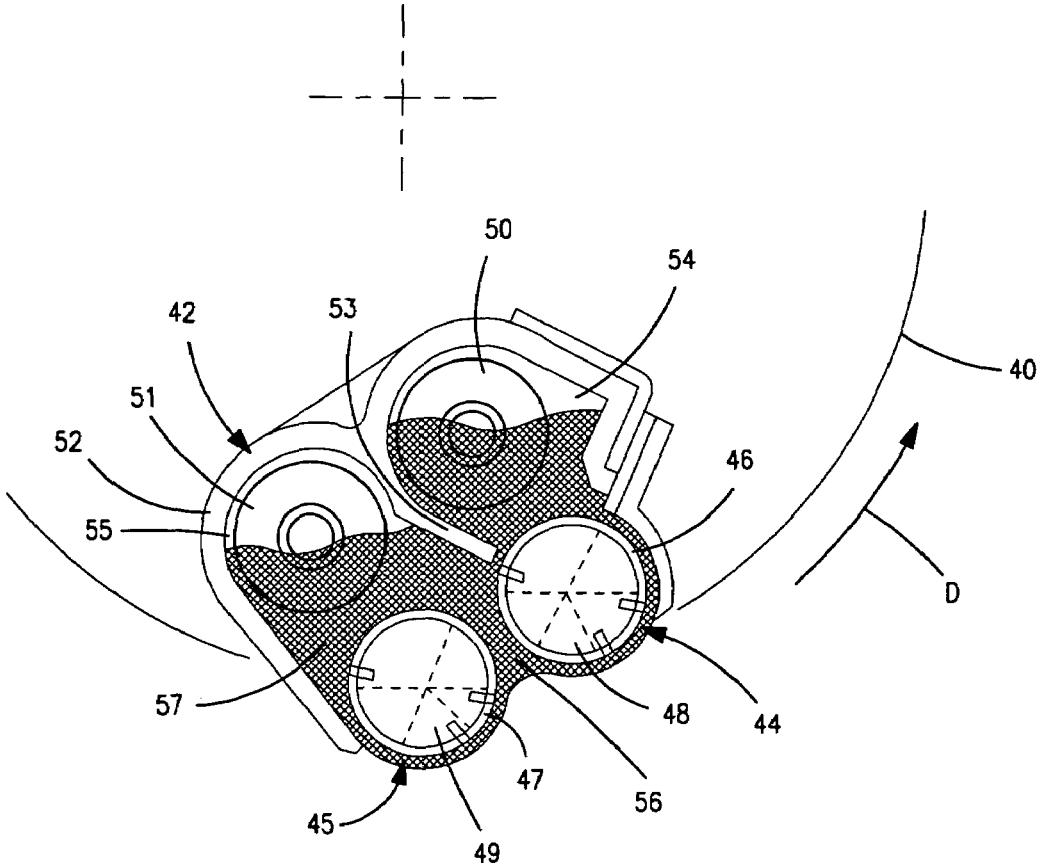
FIG. 6 PRIOR ART
FIG. 6 is a diagram showing a state in which a conventional developing device is isolated from a photosensitive drum.
Figure 7:
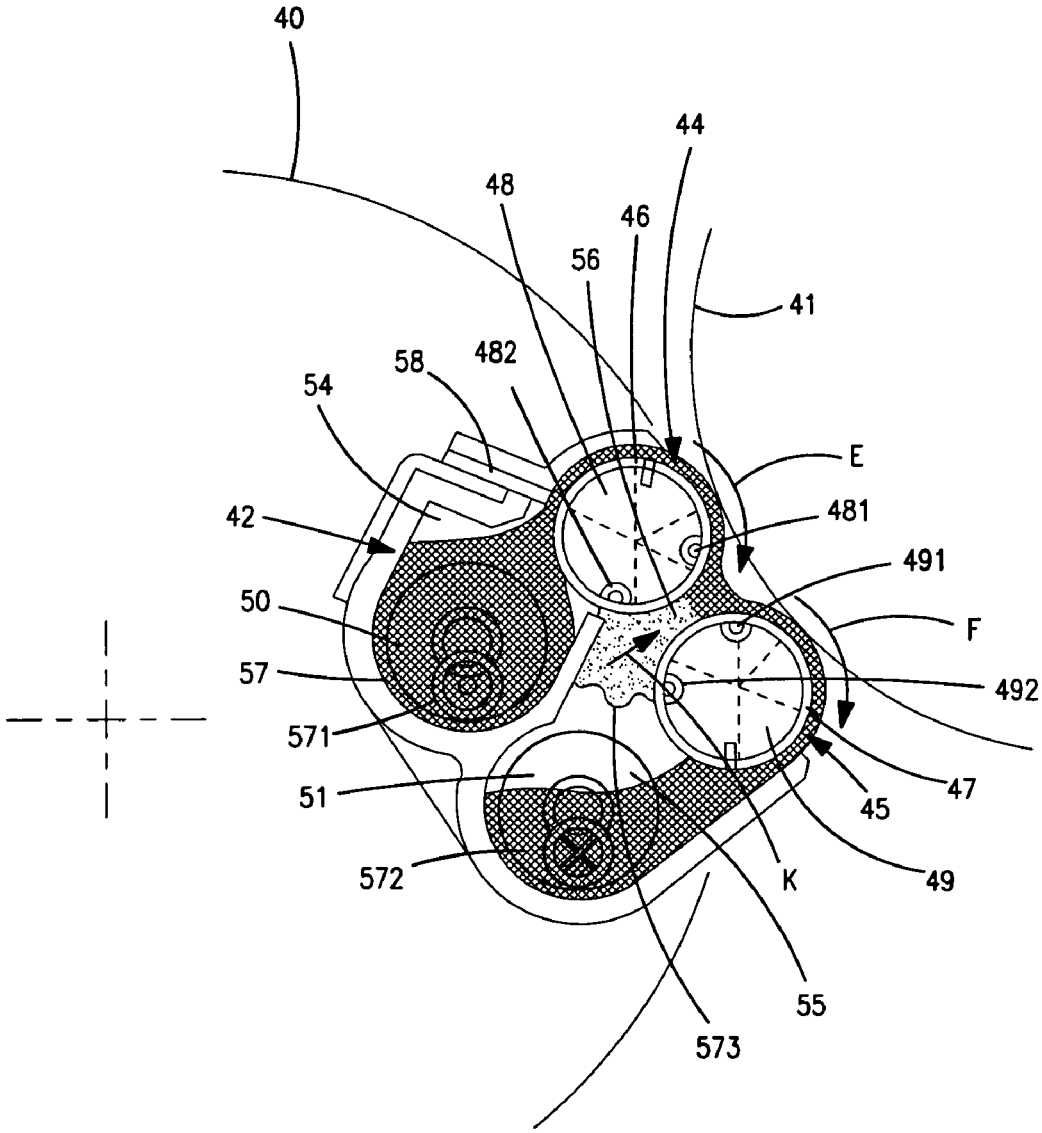
FIG. 7 PRIOR ART
FIG. 7 is a diagram showing a flow of a developer in the conventional developing device.

An embodiment of the invention is shown in FIG. 1 and FIG. 2. It is to be noted that the schematic structure of the image forming apparatus having the developing apparatus or developing device according to this embodiment is substantially the same as that of the prior art, and therefore, a detailed description is omitted. With respect to the members commonly used in the prior art, reference numbers used in the prior art are used as they are, and a detailed description is omitted.

FIG. 1, FIG. 2 are for showing two states taken by a developing device 42 in a rotary body 40. FIG. 1 is for a state that the developing device 42 is located at a position of −90 degrees with respect to a rotational direction of the rotary body 40 prior to the developing position; FIG. 2 shows the developing position.

The state shown in FIG. 1 is described. With this situation, a first developing roller 44 serving as a first developer carrier (first developing member) and a second developing roller 45 serving as a second developer carrier (second developing member) are located on a lower side, so that a developer 57 existing in the developing device 42 is deposited according to operation of gravity force as to overlap the first developing roller 44 and the second developing roller 45 as shown with "circle patterns" in FIG. 1.

In this embodiment, a diaphragm 53 constituted of a part of a developing container 52 in the developing device 42 is protruded to form a developing chamber 54 enclosed with the first developing roller 44 and a stirring chamber 55 enclosed with the second developing roller 45, respectively.

A restricting member 70 for restricting entry of the developing agent into an SS space 56 as a region between the first developing roller 44 and the second developing roller 45 is arranged as to continue to the diaphragm 53 where the front end of the diaphragm 53 is widened.

With this structure, in this embodiment, the developer 57 in the SS space 56 can be avoided from attracted by the magnetic force of a first magnet roller 48 and a second magnet roller 49 in the first developing roller 44 and the second developing roller 45 from operation of the restricting member 70.

Figure 8:
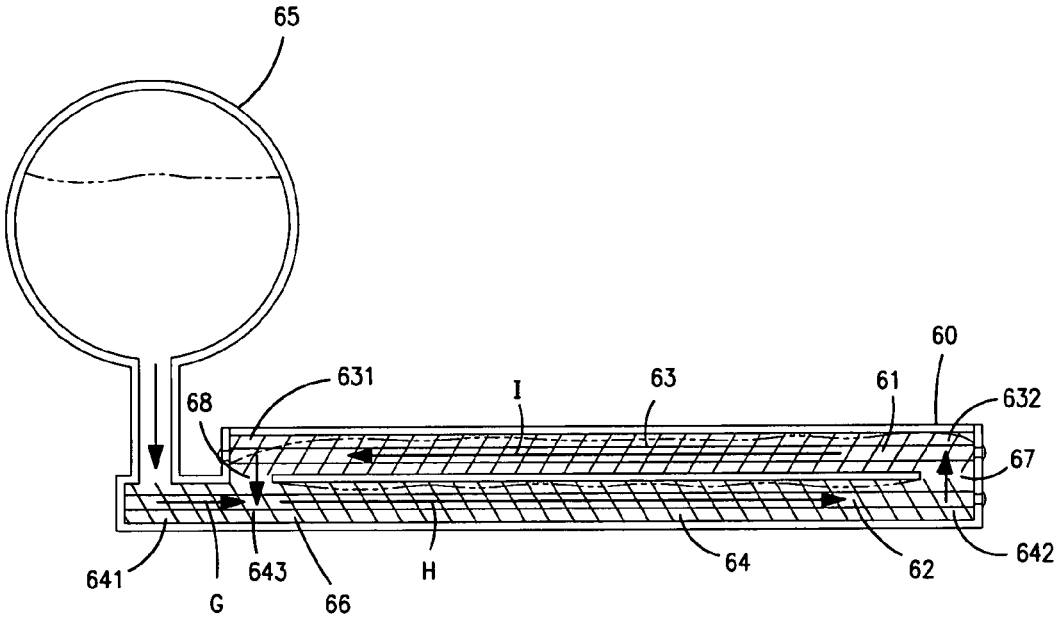
FIG. 8 is a diagram showing a flow of a developer in a cross section along a longitudinal direction of the conventional developing device.

Flow of the developer at the developing position is described next. In this embodiment, the cross-sectional structure of the developing device 42 along the longitudinal direction is equal to what is shown in the prior art (see FIG. 8), duplicated description is omitted. The flow of the developer 57 is basically the same as that of the prior art, which is for unifying the toner density of the developer 57 in the developing device 42 and for use in a process developing electrostatic latent images on a photosensitive drum 41 with the developer 57 in the developing device 42.

Herein, particularly, flow of the developer 57 with respect to the developing process is described. As shown in FIG. 2, the developer 571 in the developing chamber 54 reaches the surface of the first developing sleeve 46 in the same way as in the prior art and is carried as in a thin layer shape by means of the restricting blade 58. The developer 571 is then transferred to the second developing sleeve 47 as developing the electrostatic latent images on the surface of the photosensitive drum 41.

The developer carried on the surface of the second developing sleeve 47 performs the second development on the electrostatic latent images on the photosensitive drum 41, and enters in the stirring chamber 55 in the developing device 42 as in a state that the toner density is lowered to merge with the developer 572, which is stirred and conveyed by a second screw 51.

As described with reference to FIG. 1, because the front end of the diaphragm 53 is widened and because the restricting member 70 for restricting the entry of the developer into the SS space 56 located between the first developing roller 44 and the second developing roller 45 is disposed, the entry of the developer into the SS space 56 is prevented. It is to be noted that the diaphragm 53 is not formed as to completely partition between the developing chamber 54 and the stirring chamber 55, and the developing chamber 54 and the stirring chamber 55 are formed with a communication path permitting passage of the developer 57 around the vicinity of the opposite ends in the longitudinal direction as to constitute a circulation path of the developer 57.

The shape of the restricting member 70 is described in detail. As other features of the magnetic arrangement of the first magnet roller 48 and the second magnet roller 49 as described above, the S2 magnetic polarity 482 and S1 magnetic polarity 483, which are magnetic polarities of the same polarity adjacent to each other, are disposed at the first magnet roller 48. This is a known technology that the magnet polarities of the same polarity are disposed in parallel so that the developer 57 does not come around from the S2 magnetic polarity side on the upstream side in the rotational direction of the first developing sleeve 46 to the S1 magnetic polarity side to separate the developer 57 from the surface of the first developing sleeve 46 at a so-called "magnetic flux zero point" 484 (shown with a single dotted line) at which no magnetic flux exists between both of the polarities.

In substantially the same way, the N2 magnetic polarity 493 and the N1 magnetic polarity 492, magnetic polarities adjacent to each other, are arranged at the second magnet roller 49, thereby rendering the magnetic flux null at the "magnetic flux zero point" 494 (shown with a single dotted line) located between the magnetic polarities to separate the developer from the surface of the second developing sleeve 47.

The restricting member 70 is desirably positioned most closely to the first developing sleeve 46 and the second developing sleeve 47 at the "magnetic flux zero point" 484, 494 described above. In this embodiment, a part of the restricting member 70 is extending to a position 71 with respect to the "magnetic flux zero point" 484, whereas extending to a position 72 with respect to the "magnetic flux zero point" 494, thereby realizing the structure described above.

This structure can form a structure that the developer 57 little enters into the space between the restricting member 70 and sleeve surface at a position of the least magnetic flux amount on the developing roller 44, 45, so that with the synergy effect, the entering amount of the toner can be suppressed to the minimum amount to the SS space 56.

The restricting member 70, at least, may be desirably formed to have the narrowest space to the sleeve 46, 47 around the "magnetic flux zero point" 484, 494 even where not reaching the positions 71, 72 as in this embodiment.

According to an experiment, by setting the space at the closest position between the restricting member 70 described above and the sleeve to 2 mm or lower, an advantage was obtained for prevention of entry of the developer 57 to the SS space 56.

With the structure described above, even where the developing device 42 moves to the developing position in FIG. 2, the developer 57 still does not enter into the SS space 56. That is, the developer 57 deteriorated may not be re-coated on the second developing roller 45.

As described above, according to the embodiment, since the restricting member 70 is disposed for restricting the entry of the developer 57 to the region (the SS space 56) sandwiched between the first developing roller 44 and the second developing roller 45 extending adjacent to each other as well as the region of the interior of the developing container 52, the developer 57 may not enter into the SS space 56 serving as the above region, so that the developer 57 is avoided to be coated more than the necessary amount on the second developing roller 45, and so that blurs and overflows from the developing container 52 are prevented to bring developing images with higher quality.

[Second Embodiment]

This invention is not limited to the rotary type image forming apparatus described above, and is applicable to an inline type image forming apparatus in which four developing devices are arranged. It is to be noted that because the image forming apparatus shown in FIG. 9 has substantially the same structure as that of the first embodiment except the developing devices are arranged in parallel, members and apparatuses having the same functions are assigned with the same reference numbers, and a detailed description is omitted.

Figure 9:
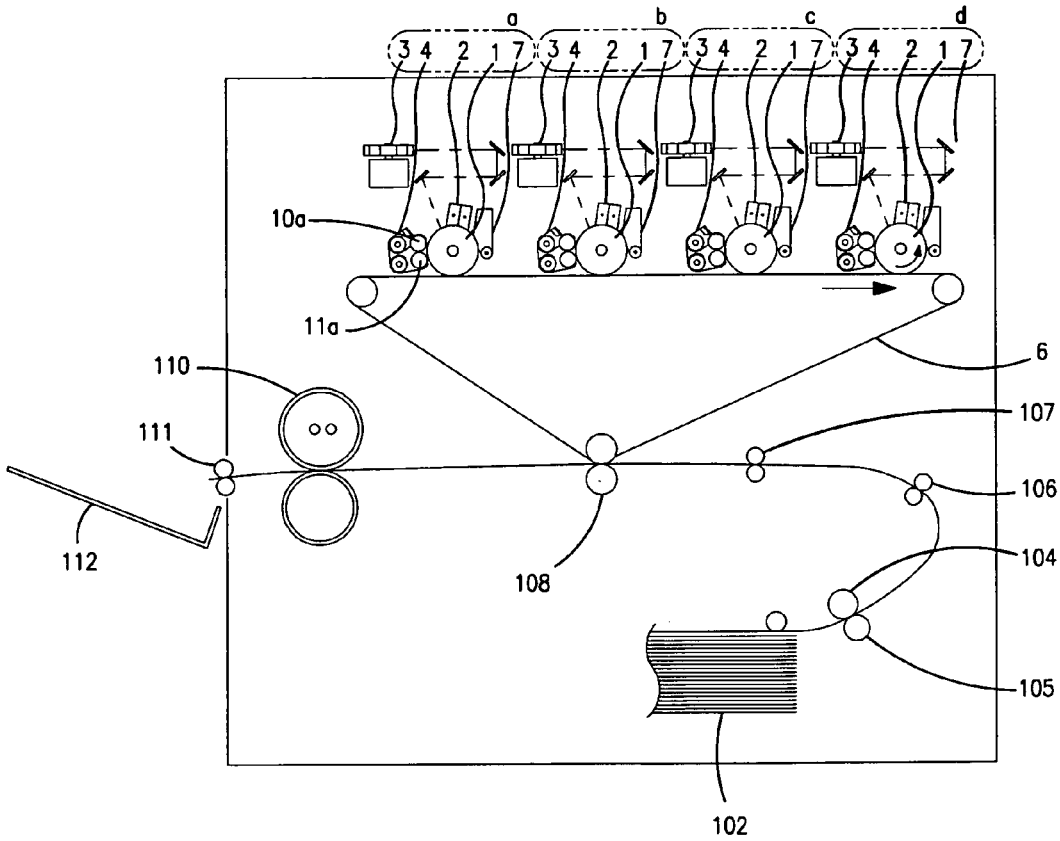
FIG. 9 is an illustration showing another embodiment of the color image forming apparatus mounting a developing device according to the invention.
Figure 10:
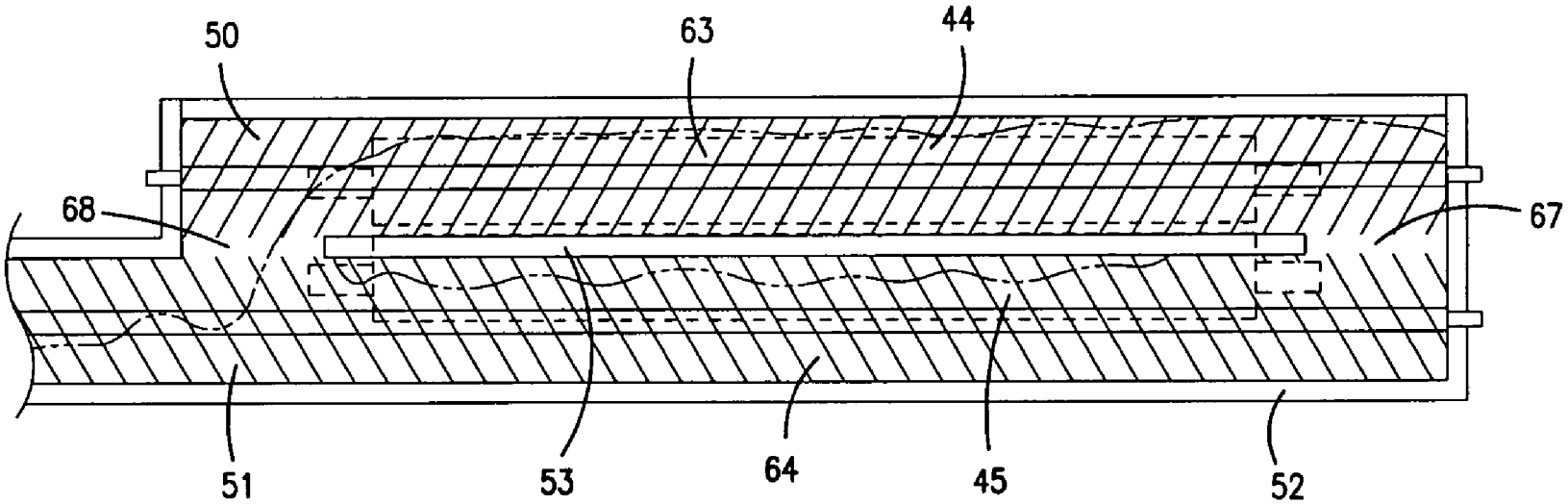
FIG. 10 is a detailed diagram showing the interior of the developing device in FIG. 9.

FIG. 10 shows a detailed structure of the developing apparatus shown in FIG. 9. The outline of the developing apparatus is as follows: the developing container is partitioned to, as upper and lower, a developing chamber 63 and a stirring chamber 64 with the diaphragm 53 (the stirring chamber is located on a lower side of the developing chamber 63 in the gravity force direction), and a magnetic developer having a non-magnetic toner and a magnetic carrier is sent to a developing chamber 63 upon pushed up by a second screw 51 at a path 67 on an end side in the longitudinal direction of the stirring chamber 64. It is to be noted that the drawing depicted as to overlap the developing chamber 63 with the stirring chamber 64 shows a first developing roller 44 and a second developing roller 45.

Therefore, the powder surface of the developer around the path 67 of the stirring chamber 64 is lifted up as to reach the diaphragm 53 as shown with a double-dotted chain line in the drawing.

If the agent surface of the developer is lifted up, the developer may enter into a gap between the first developing roller 44 and the second developing roller 45, in substantially the same manner as in the first embodiment, or namely the SS space 56, so that consequently, the coating amount of the developer on the second developing roller 45 is raised, thereby possibly rendering defective the image density.

A restricting member 70 is formed to restrict the entry of the developer by protruding the shape of the diaphragm 53 in substantially the same manner as in the first embodiment, thereby preventing the developer from entering into the SS space 56.

It is to be noted that the restricting member 70 is provided across substantially the entire region along the longitudinal direction of the first and second developing rollers 44, 45 because the entry of the developer into the SS space 56 is done at the entire region in the longitudinal direction at the developing apparatus mounted on the developing rotary described above, but in this embodiment, the restricting member 70 is preferably formed at least around the path 67 because the developing apparatus is stationally arranged.

[Other Embodiments]

According to the first and second embodiments, exemplified as the restricting member is the restricting member, unitedly formed with the container, in which the front end of the diaphragm formed by protruding the part of the container is widened, but the member is not limited to this, and can be a separate member. The shape of the restricting member is not limited to the shape shown in FIG. 1 and FIG. 2, and other shapes can be possible as far as the shape restricts the entry of the developer into the SS space as the above region. It is to be noted that as described in the first and second embodiments, it is desirable to set the restricting member as extending along the circumferential surfaces of the first developing roller and the second developing roller.

In the above embodiments, exemplified as a developing apparatus having plural developer carriers is a developing apparatus having two developer carriers (first developer carrier and second developer carrier), but the number of the developer carriers is not limited to this.

In the above embodiments, exemplified is an image forming apparatus having the four developing devices, but the used number is not limited and can be set properly according to the necessity. Exemplified also is the image forming apparatus capable of forming color images, but this invention is not limited to this, and this invention is applicable to a developing apparatus used in an image forming apparatus capable of forming monochrome images.

Although in the above embodiments the printer is exemplified as the image forming apparatus, this invention is not limited to this, and this invention applicable to image forming apparatuses such as, e.g., photocopiers, facsimile machines, other image forming apparatuses such as combined machines combining those functions, and image forming apparatuses using a transfer carrier and multiply transferring toners of respective colors to a transfer material carried on a transfer material carrier in a sequentially overlapping manner, so that substantially the same advantages can be obtained in applying this invention to such image forming apparatuses.

As described above, according to the above embodiments, coating of the developer more than the necessary amount on the developer carrier can be avoided, so that blurs of the developer and overflows from the developing container can be prevented, thereby producing developing images with high quality.

What is claimed is:

1. A developing apparatus for developing an electrostatic image formed on an image carrier, comprising:

a developing container for containing a magnetic developer, the developing container being divided into a first chamber and a second chamber constituting a circulation path of the developer, the first chamber being disposed on an upper side of the second chamber;

a first developing member, provided within the first chamber, for supplying the developer to the electrostatic image on the image carrier;

a second developing member, provided within the second chamber, for supplying the developer to the electrostatic image on the image carrier; and a magnetic field generating means for generating a magnetic field for transferring the developer from the first developing member to the second developing member; and a restricting member for restricting entry of the developer in the developing container to a space between the first developing member and the second developing member, the restricting member being disposed in the developer container in a non-contacting manner with the first developing member and the second developing member.

2. The developing apparatus according to claim 1, wherein the restricting member is provided extending substantially along a circumferential surface of the second developing member.

3. The developing apparatus according to claim 1 or claim 2, wherein the magnetic field generating means has a pair of magnetic polarities disposed stationarily in the second developing member for forming a resilient magnetic field, and the restricting member is disposed in a non-contacting manner with but adjacent to the magnetic polarity pair.

4. The developing apparatus according to claim 3, wherein the first developing member carries the developer in the first chamber and conveys the developing agent to the image carrier the first developing portion, and wherein the second developing member carries the developer received from the first developing member and conveys the developer to the image carrier.

5. The developing apparatus according to claim 1, wherein the restricting member is provided extending substantially along circumferential surfaces of the first developing member and the second developing member.

6. The developing apparatus according to claim 1 or claim 5, wherein the magnetic field generating means has a pair of magnetic polarities disposed stationarily in the first developing member for forming a resilient magnetic field and a pair of magnetic polarities disposed stationarily in the second developing member for forming a resilient magnetic field, and the restricting member is disposed in a non-contacting manner with but adjacent to the magnetic polarity pairs.

7. The developing apparatus according to claim 6, wherein the first developing member carries the developer in the first chamber and conveys the developer to the image carrier, and wherein the second developing member carries the developer received from the first developing member and conveys the developer to the image carrier.

8. The developing apparatus according to claim 1, wherein the restricting member includes a dividing portion for dividing the developing container into the first chamber and the second chamber.

9. The developing apparatus according to claim 1, wherein the magnetic developer includes a non-magnetic toner and a magnetic carrier.

* * * * *

UNITED STATES PATENT AND TRADEMARK OFFICE

CERTIFICATE OF CORRECTION

PATENT NO. : 7,010,253 B2
APPLICATION NO. : 10/727620
DATED : March 7, 2006
INVENTOR(S) : Hiroaki Kakimoto It is certified that error appears in the above-identified patent and that said Letters Patent is hereby corrected as shown below:

COLUMN 3:

Line 48, “an” should read --a--.

COLUMN 4:

Line 49, “with” should read --to--.

COLUMN 5:

Line 44, “scattered” should read --being scattered--;
Line 57, “exists” should read --exits--; and
Line 59, “a” should read --the--.

COLUMN 10:

Line 29, “upon” should read --upon being--.

COLUMN 12:

Line 21, “developing agent” should read --developer--; and
Line 22, “carrier the first developing portion.” should read --carrier,--.

Signed and Sealed this

Twenty-ninth Day of August, 2006

JON W. DUDAS
*Director of the United States Patent and Trademark Office*